United States Patent [19]

Forbes, Jr. et al.

[11] 3,946,937

[45] Mar. 30, 1976

[54] EASY OPENING CARTON

[75] Inventors: Hampton E. Forbes, Jr.; George Breylinger, both of Wilmington, Del.

[73] Assignee: Westvaco Corporation, New York, N.Y.

[22] Filed: Jan. 13, 1975

[21] Appl. No.: 540,439

Related U.S. Application Data

[63] Continuation-in-part of Ser. No. 350,712, April 13, 1973, abandoned.

[52] U.S. Cl. ..... 229/51 TC; 229/37 E; 229/51 TS

[51] Int. Cl.[2] ..... B65D 5/54

[58] Field of Search.... 229/51 TS, 51 TC, 38, 39 R, 229/51 DB

[56] References Cited

UNITED STATES PATENTS

| | | | |
|---|---|---|---|
| 2,267,320 | 12/1941 | Berch | 229/51 TC |
| 2,305,631 | 12/1942 | Moore | 229/51 TS |
| 2,390,412 | 12/1945 | Axberg | 229/51 TC |
| 2,685,400 | 8/1954 | MacArthur | 229/51 TC |
| 2,959,338 | 11/1960 | Thurston | 229/51 DB |
| 3,092,301 | 6/1963 | Selle | 229/51 DB |
| 3,108,735 | 10/1963 | Meyers | 229/51 TS |
| 3,135,457 | 6/1964 | Risucci | 229/51 DB |
| 3,176,904 | 4/1965 | Collura | 229/38 |
| 3,366,310 | 1/1968 | Simpson et al. | 229/51 TC |
| 3,368,739 | 2/1968 | Roccaforte et al. | 229/51 TC |
| 3,708,104 | 1/1973 | Buttery | 209/51 TS |
| 3,844,472 | 10/1974 | Mueller | 229/51 TC |
| 3,865,322 | 2/1975 | Hennessey | 229/51 TC |

*Primary Examiner*—William Price
*Assistant Examiner*—Bruce H. Bernstein

[57] ABSTRACT

A thin profile carton is formed from a single blank of paperboard consisting of a plurality of side walls joined to one another to form a rectangularly shaped carton having a depth dimension from front-to-back substantially less than its width dimension with an improved ripped, carton opening scheme at the top end thereof. The top end opening feature comprises a single, substantially straight, cut and scored line of weakness in one of the top end closure flaps of the carton, which line of weakness extends completely across the end closure flap and intersects at least one fold line in said end closure flap. The fold line defines at least one carton opening tab that is an integral part of said end closure flap.

7 Claims, 12 Drawing Figures

EASY OPENING CARTON

SUMMARY OF THE INVENTION

The present application is a continuation-in-part of applicant's copending application, Ser. No. 350,712, now abandoned, filed Apr. 13, 1973, for EASY OPENING CARTON.

The present invention relates generally to an easy opening carton formed from a paperboard blank which is cut, scored and perforated to define a rectangularly shaped carton having a plurality of side walls with end closure flaps hinged to the free ends thereof.

More particularly, the present invention is directed primarily to a rectangularly shaped carton as defined above wherein the depth dimension of the carton from front-to-back is substantially less than its width dimension from side-to-side. In each case, the end closure flaps consist of an opposed pair of spaced dust or secondary flaps located along the depth dimension of said carton and an opposed pair of spaced and interengageable closure or primary flaps located along the width dimension of said carton which are sequentially folded and secured to one another over the secondary or dust flaps. In addition, the present invention features an easy opening scheme consisting of a single perforated tear line located in the uppermost primary end closure flap at the top end of the carton.

In its most elementary state, the present invention takes the form of an economy, fully sealed end closure carton wherein the primary top and bottom end closure flaps are not full sized, i.e., they do not extend from one side of the carton to the opposed side when folded closed. Further, in the economy form, the ripped easy opening feature is applied to the uppermost or second folded primary or interengageable end closure flap at the top of the carton in the form of a single, substantially straight line of perforations which form a line of weakness completely across the end closure flap. The line of weakness serves to divide the uppermost primary flap into two portions. One of the portions is foldably attached to an adjacent carton side wall, and includes at least one integral carton opening tab defined by a score line at one side of the end closure flap, and a second portion which is adhered to the lowermost primary flap. Thus, in order to seal the economy carton closed, adhesive is applied to either the inside of the uppermost end closure flap outboard of its line of weakness, or to the outside of the lowermost end closure flap substantially near its free edge away from its point of articulation to the adjacent carton side wall. Accordingly, the lowermost and uppermost primary closure flaps overlap one another only at their extreme ends, since they are not full sized, and only that portion of the uppermost closure flap outboard of the line of weakness is adhered to the lowermost closure flap. The thus sealed carton is opened by inserting a finger or letter-opener type tool underneath the carton opening tab provided therefor, whereupon by sliding the finger or letter-opener type tool along the line of perforations, the uppermost primary flap may be separated along its line of weakness leaving its outboard portion attached to the lowermost flap and the carton is opened.

Accordingly it may be seen that the economy carton described herein, with its minimum use of paperboard and minimum depth dimension involved, could not successfully employ one of the conventional tear rab opening devices normally used on cartons of a similar type. In this regard, the easy opening device provided by the present invention is believed to be an improvement over and novel in view of the teachings of the prior U.S. Pat. Nos. 1,985,590 to Weiss, 3,366,310 and 3,366,311 to Simpson et al., and 3,263,899 to Collura et al.

In other embodiments according to the present invention the primary top closure flaps may be made full sized, i.e., so as to extend completely across the carton top from one side to the other opposed side, and for this latter form, a provision may be made for reclosing the carton top after opening. In each case however, the uppermost closure flap is applied with a single, substantially straight perforated line of weakness along its width dimension, and where the closure flaps are full sized, the lowermost closure flap is formed with a tuck slot located to lie underneath the perforated line of weakness in the uppermost closure flap. Thus, after the carton with full sized closure flaps is applied with adhesive and sealed closed substantially as described hereinbefore with respect to the economy carton, the carton may be opened as set forth previously and then reclosed by tucking the exposed edges of the ripped portion of the uppermost closure flap which remains attached to its adjacent side wall underneath the tuck slot provided in the lowermost closure flap.

In yet still another embodiment of the present invention, the perforated line of weakness in the full sized uppermost closure flap may be reshaped in the region of the tuck slot in the lowermost closure flap to provide an even more secure carton reclosure mechanism.

However, for each of the cases described above, the novel easy opening device anticipated is primarily for use on cartons which have a thin profile or minimum depth dimension as compared to its width. Thus the invention disclosed herein consists essentially of a single, substantially straight perforated line of weakness in the uppermost primary closure flap for the top of a thin profile carton, which perforated line of weakness divides the uppermost primary closure flap into two portions, one of which becomes attached to the lowermost primary closure flap, and the other of which remains foldably attached to its adjacent carton side wall. In addition, the portion of the top closure flap remaining attached to the adjacent carton side wall also includes as an integral part thereof, at least one carton opening tab for initiating the easy opening mechanism.

DETAILED DESCRIPTION

Figure 1:
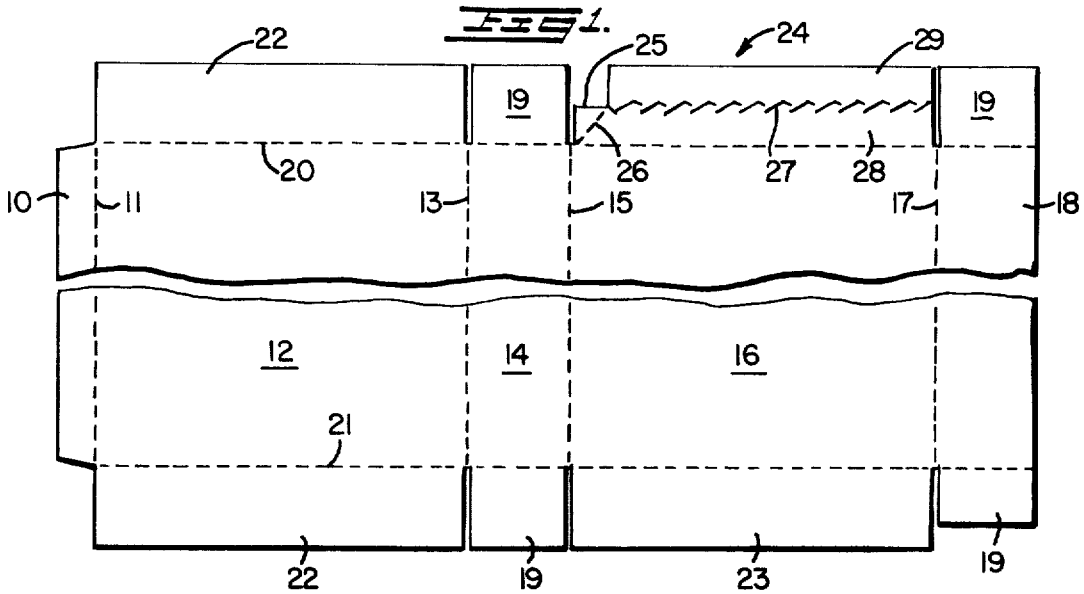
FIG. 1 is a plan view of a blank from which the carton herein may be constructed.

The present invention relates to a simple, efficient and improved ripped carton opening scheme particularly adapted for thin profile cartons which have a minimum depth dimension thereby making a conventional tear strip opening arrangement impractical and impossible. In its preferred form, the invention is directed to a thin, rectangularly shaped carton having opposed side walls with top and bottom closure flaps attached thereto, wherein the easy opening feature is applied to one of the top closure flaps of the carton. Moreover, the easy opening means of the present invention can be incorporated in economy type cartons wherein the carton closure flaps are of a lesser dimension than the already minimum depth dimension of the carton in a direction normal to the hinge lines of the carton closure flaps, i.e., which closure flaps do not extend completely over the carton top, although they are of sufficient length to overlap one another in the region where they are secured together. In addition, however, the ripped, easy opening means described herein is also readily adaptable to cartons wherein the top closure flaps completely overlap one another. For this latter case, the simple and efficient easy opening means preferred is more reliable than the conventional tear strip opening arrangement usually employed, and it also permits reclosure of the carton after opening much like the normal tear strip opening cartons. Furthermore, it should also be understood that while the easy opening means disclosed is particularly described and illustrated for use on a carton having a minimum depth dimension from front-to-back, the same easy opening means could also be used on the end of a carton having a minimum depth dimension from top-to-bottom.

Therefore, for the purposes of the present invention, the ripped, easy opening means comprises a single, substantially straight perforated weakened line in the uppermost primary closure flap of a carton, which weakened line extends completely across the top of the carton along the width dimension of the carton, and which includes at one or both ends thereof an integral carton opening tab useful for initiating the carton opening mechanism. The perforations or lines of incision which define the weakened line in the uppermost closure flap are preferably uniformly resistant to rupture with no pre-weakened section, and such rupturing is carried out simply by grasping the carton opening tab with one's finger or some other letter-opening type tool, and then sliding the finger or tool along the line of perforations from one side of the carton to the other to effect the opening of the carton.

The benefits achieved with the single perforated line easy opening means of the present invention, as compared with conventional tear strip opening means, especially when applied to cartons having a minimum depth dimension, include both structural, manufacturing and esthetic advantages. In both cases where the carton closure flaps completely overlap or only partially overlap, the use of only a single perforated ripped opening line permits a greater sealing area between the two overlapping flaps yielding more structural integrity to the carton. The invention disclosed herein would not be particularly useful in cartons where the depth from front-to-back was equal to or greater than the width, especially with only partially overlapping top closure flaps, since the natural "fluffing" tendency of the paperboard used to make the cartons would prohibit a tight closure. Thus the opening scheme disclosed herein is particularly adapted to thin profile cartons. In addition, when only a single perforated line is employed, there is less breakup of the printing on the closure flap than would occur with a conventional tear strip opening requiring two perforated lines. Moreover, with respect particularly to shallow depth cartons, the use of a single perforated opening line means that the runnability of the carton is improved since the single weakened line may be located farther away from the closure flap hinge lines than is possible for conventional tear strip opening schemes. Finally, the single perforated ripped opening means of the present invention is also able to accommodate the desirable reclosing feature often used in conventional tear strip cartons. As particularly illustrated in the drawing included herewith, the reclosure feature may be accomplished either using the raw edge of the perforated line or with a reclosure tab integral with the perforated line.

Referring now more particularly to the drawing, it will be noted that the carton blank of FIG. 1 consists of a plurality of side wall panels 12, 14, 16 and 18 joined together along parallel fold lines 13, 15 and 17 and a glue flap 10 attached to side wall panel 12 along the fold line 11. In each case, the side wall panels have top and bottom closure flaps foldably attached to the free ends thereof along fold lines 20, 21 with top and bottom closure flaps 19 being attached to the minimum width side walls 14 and 18 and top and bottom closure flaps 22 being attached to the larger width side wall 12. Side wall 16 has attached thereto a conventional bottom closure flap 23 and a top closure flap 24 which includes the novel carton opening means disclosed herein.

Figure 2:
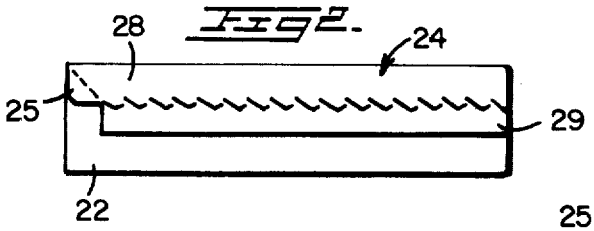
FIG. 2 is a top view of the formed and sealed carton formed from the blank of FIG. 1.

It will be appreciated by a careful observation of FIG. 1 that the top closure flaps 23,24 are not full sized, i.e., their length dimension is not equal to the width dimension of the side walls 14, 18, therefore the blank of FIG. 1 is used to form an economy style shallow depth carton having a depth dimension measured from front-to-back. The carton so formed is shown in FIG. 2 and open in FIG. 3. However, further reference to FIG. 1 will illustrate the novel simplicity of the ripped easy opening means disclosed. Note that top closure flap 24, which is the uppermost closure flap when the carton is closed, includes only a single perforated weakened line 27 which extends completely across the width of flap 24 in a substantially straight line. Perforated line 27 is located near the center of flap 24 from side-to-side and continues throughout the width thereof to divide the flap 24 into two portions 28, 29. The portion 28 is foldably attached to the adjacent side wall 16 and the portion 29 is adapted to partially overlap and become adhered to the lowermost closure flap 22 when the carton is sealed closed after filling. In addition, the closure flap portion 28 at one end thereof includes as an integral part thereof a carton opening tab 25 separated from the portion 28 along a diagonal fold line 26. The carton opening tab 25 is a necessary part of the novel ripped opening means disclosed since manipulation of same permits the initiation of the rupture along the single tear line 27 which effects the opening mechanism of the carton. If desired, a second carton opening tab 25' could be added to the opposite end of the closure flap portion 28 particularly as used in the divided carton shown in blank form in FIG. 10 and as fully formed in FIG. 12. This latter expedient would not deleteriously affect the carton closure and it would provide the consumer with the option of opening the carton shown in FIG. 2 either from left-to-right or right-to-left.

The carton is formed, filled and finally sealed as shown in FIG. 2, and as will be noted therein, the uppermost closure flap 24 only overlaps the lowermost closure flap 22 in the region of the portion 29 of flap 24. The sealing step is accomplished after the carton is filled by applying adhesive either to the inside of the portion 29 of flap 24, or to the outside of flap 22 in the region near the free edge thereof, away from the fold line 20. It will further be noted in FIG. 2 that the location of the novel single perforated tear line 27 is located substantially at the geometric center of the carton top taken from side wall 12 to side wall 16. Thus after the carton is squared, the orientation of the perforated tear line 27 is substantially equidistant from the two adjacent side edges of the carton top defined by the fold line 20, and because of this orientation, there is ample distance from each side edge to the perforated line 27 to provide significant structural strength to the thin profile carton while still achieving good machine runnability of the carton during the forming, filling and sealing steps. In addition, by locating the single weakened line at or near the geometrical center of the carton, the effectiveness of the opening means is enhanced, especially in thin profile cartons, because there is less chance of the ripped opening to fail during the rupturing process.

Figure 3:
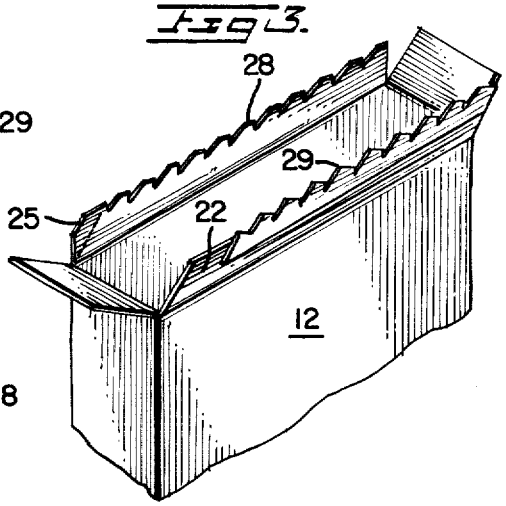
FIG. 3 is a partial perspective view of the carton of FIG. 2 in an open condition.

FIG. 3 shows the carton of FIG. 2 in its open condition effected by lifting carton opening tab 25 to initiate rupture along perforated line 27, and then manipulating the portion 28 of closure flap 24 along the length of perforated line 27 to complete the rupture. As stated hereinbefore, the opening mechanism is accomplished by sliding ones finger along the perforated line 27 beneath portion 28 and on top of portion 29 of closure flap 24. Alternatively, any other letter opener type instrument including a knife could accomplish the same result. Thus it will be seen in FIG. 3 that the portion 28 of top closure flap 24 remains attached to the carton side wall 16 while the portion 29 which overlapped and was adhered to lowermost closure flap 22 remains fixed thereto. Accordingly, the economy carton disclosed in FIGS. 1–3, with its single, substantially straight perforated tear line extending completely across the top closure flap 24, in conjunction with the unique integral carton opening tab 25, represents a novel combination of features to withstand the rigors of packaging and handling, and shipping abuses normally encountered by cartons while still retaining the easy opening feature desired in a compact, economical thin profile carton.

FIGS. 4–7 show a second embodiment of the present invention, wherein the carton forming elements utilized are the same or equivalent to those elements used in the carton of FIGS. 1–3, except that the top closure flaps 22, 24 are made full sized. That is, in the blank of FIG. 4, and as shown particularly in the partial perspective views of the carton in FIGS. 5 and 7, the top closure flaps 22,24 are seen to completely overlap one another and extend from side wall 12 to side wall 16. In addition, the embodiment of FIGS. 4–7 also differs from the embodiment of FIGS. 1–3 with respect to the addition of a carton reclosure slit 30 in the lowermost closure flap 22 which is adapted to engage the serrated free edge of the carton flap 24 for reclosing a previously opened carton.

Figure 12:
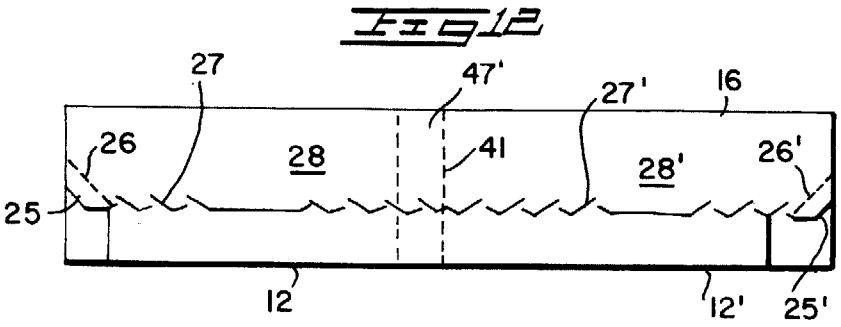

However, the basic concept of a single perforated tear line easy opening feature as fully explained in connection with the description of FIGS. 1–3 also applies to the embodiment of FIGS. 4–7. In this regard, note in FIG. 5 that the location of the single, substantially straight perforated line 27 in top closure flap 24 is substantially as disclosed before, i.e., in the geometrical center, from side to side, of the closure flap 24 and extending completely across the top of the carton, from a free edge of the closure flap to the intersection with the fold line 26 in the closure flap which defines the carton opening tab 25. Moreover, as indicated hereinbefore with respect to the economy style carton, a second carton opening tab 25' could be added to the opposite end of the closure flap portion 28 of the embodiment illustrated in FIGS. 4–7, as shown in FIG. 12, to provide the same carton opening convenience previously mentioned. Thus it may be seen that by employing only one substantially straight perforated line in the closure flap 24, a rather large sealing area is provided for the top of the thin profile carton equal to nearly half of the carton depth from front to back. This arrangement further provides less disruption to the printed surface of the closure flap 24, while still insuring sufficient strength for withstanding rough handling of the carton, and also guarantees improved runnability of the carton on high speed machinery since the perforated line 27 is located a maximum distance from each carton side edge. Obviously these features insure the reliability and performance of the ripped easy opening means disclosed as compared with prior art tear strips.

Figure 5:
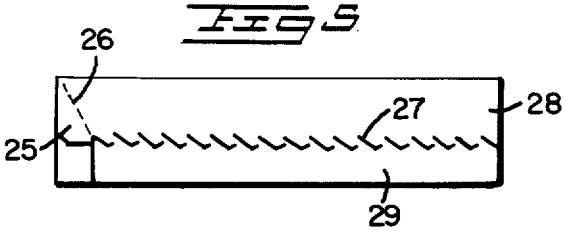
FIG. 5 is a top view of the formed and sealed carton formed from the blank of FIG. 4.
Figure 4:
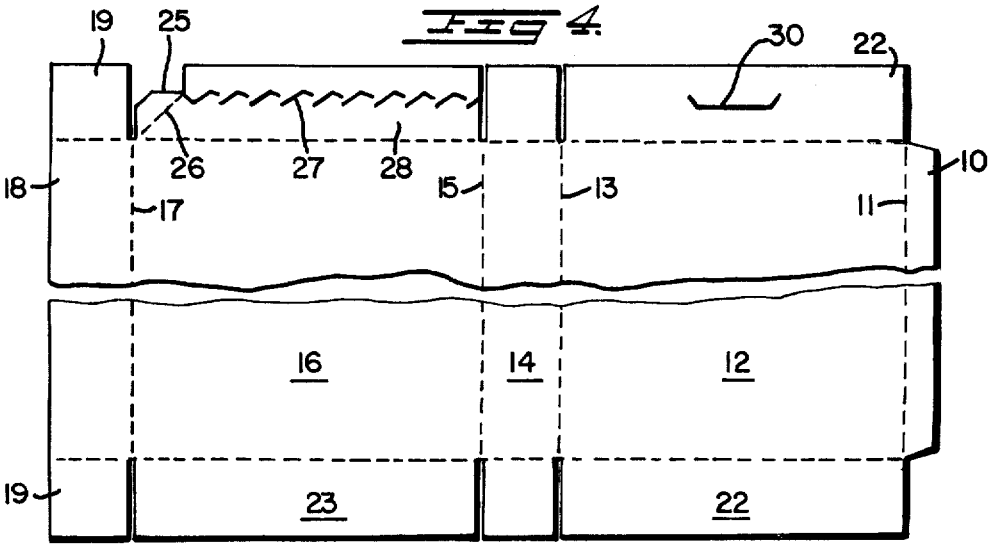
FIG. 4 is a plan view of a modified blank for constructing the carton of the present invention.
Figure 6:
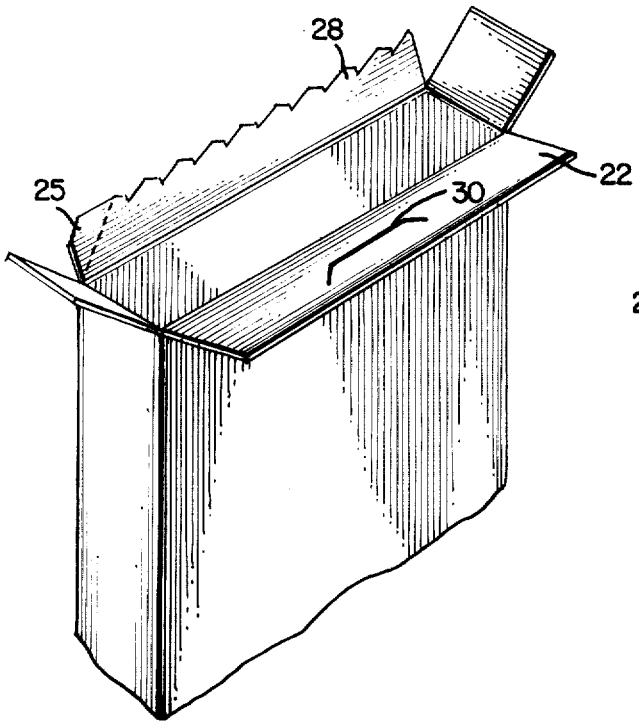
FIG. 6 is a partial perspective view of the carton of FIG. 5 in an open condition.

FIG. 6 shows the carton of FIG. 5 in its opened condition with portion 28 of closure flap 24 attached to side wall 16 and portion 29 of top closure flap 24 adhesively secured to the lowermost closure flap 22. Both the carton top sealing and opening schemes, described hereinbefore in connection with the description of the carton of FIGS. 1–3, apply to the carton shown in FIGS. 5 and 6.

Figure 7:
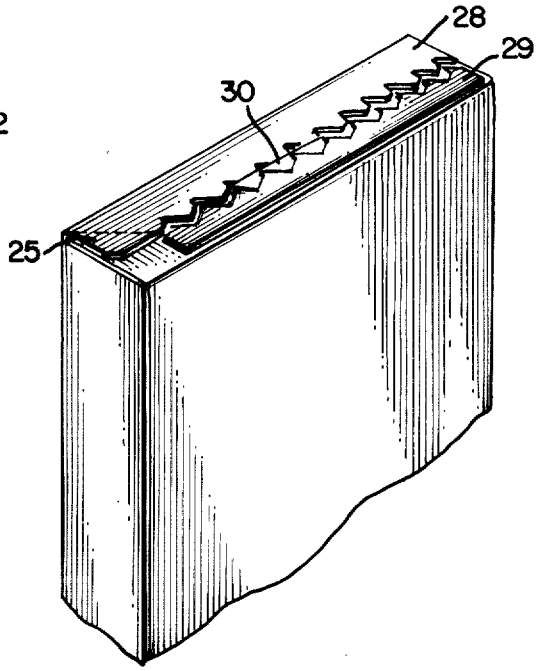
FIG. 7 is a partial perspective view of the carton of FIG. 6 in its reclosed condition.

FIG. 7 shows the carton of FIG. 6 in its re-closed condition. In the preferred embodiment, the reclosure slit 30 is carefully located within the lowermost closure flap 22 so that the ruptured free edge of portion 28 of closure flap 24 coincides therewith in the re-closed condition. Thus for the purpose of reclosing the carton shown in FIG. 6, it is only necessary to insert the serrated edge of portion 28 underneath the slit 30 shown in FIG. 7.

Figure 8:
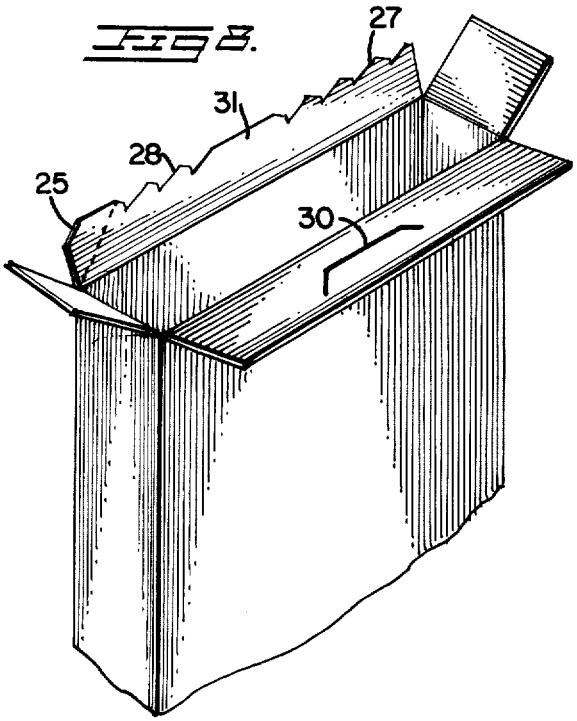
FIG. 8 is a partial perspective view showing a modification of the carton of FIG. 6.
Figure 9:
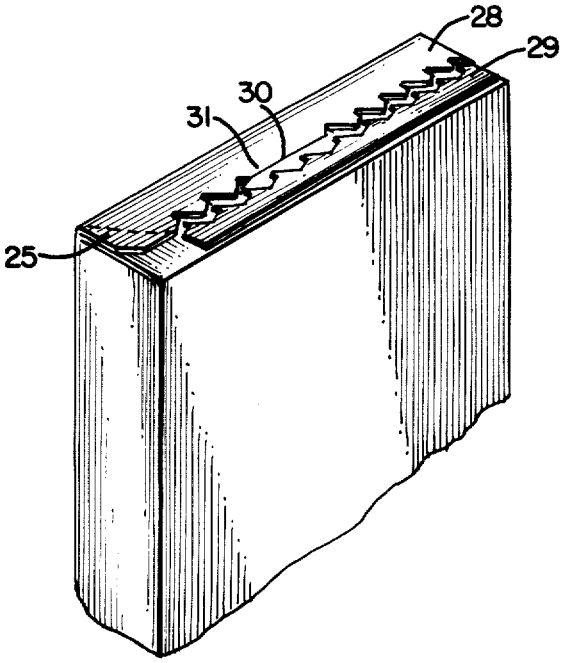
FIG. 9 is a partial persepctive view of the carton of FIG. 8 in its reclosed condition.

However, if a more substantial reclosure mechanism is desired for the carton disclosed in FIGS. 4–7, the modification shown in FIGS. 8–9 could easily be added. For this purpose, FIG. 8 shows how the perforated line 27 has been reshaped at or near the center thereof to provide a lock tab 31 which more-or-less matches the locking slit 30. FIG. 9 illustrates the modified carton in its re-closed condition with the lock tab 31 engaged beneath the lock slit 30. Thus by reason of the construction and arrangement of the modified carton closure in FIGS. 8–9, the locking tab 31 is more substantial than the serrated edge of FIG. 7, and it may therefore be inserted and withdrawn from slot 30 a reasonable number of times consistent with the use of the contents of the carton.

Figure 10:
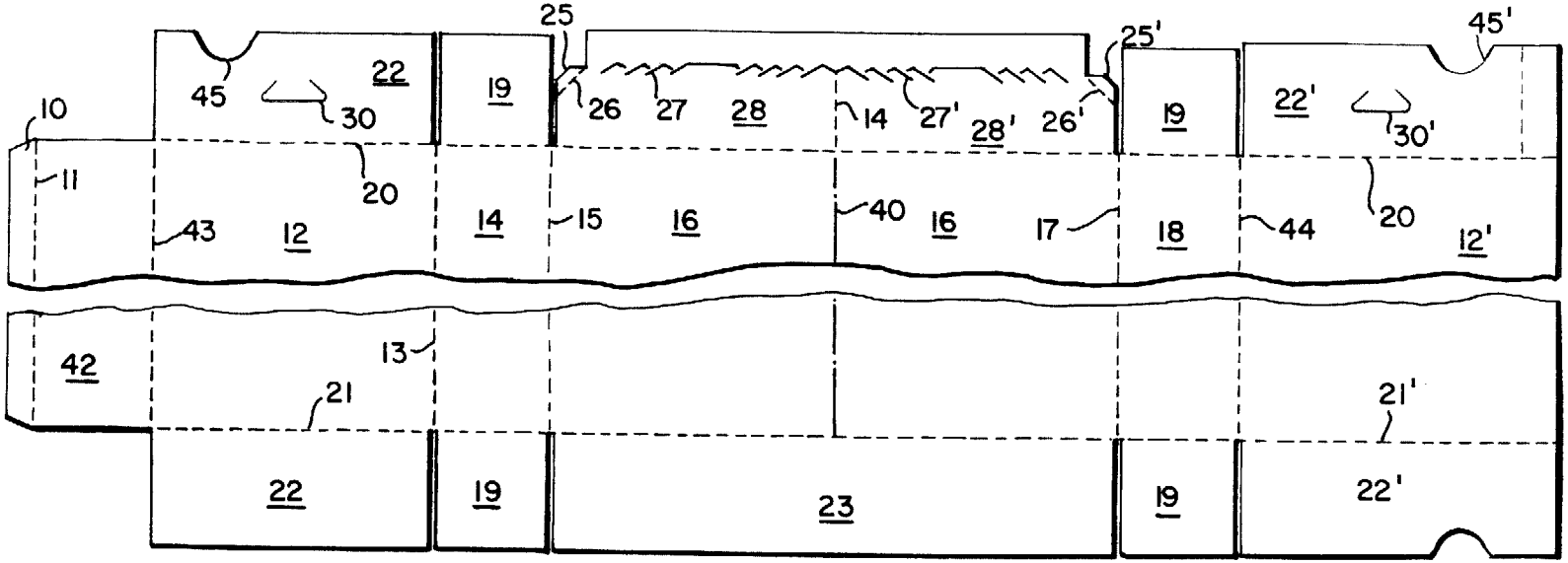
FIG. 10 is a plan view of a modified blank for constructing a two compartment carton according to the present invention.
Figure 11:
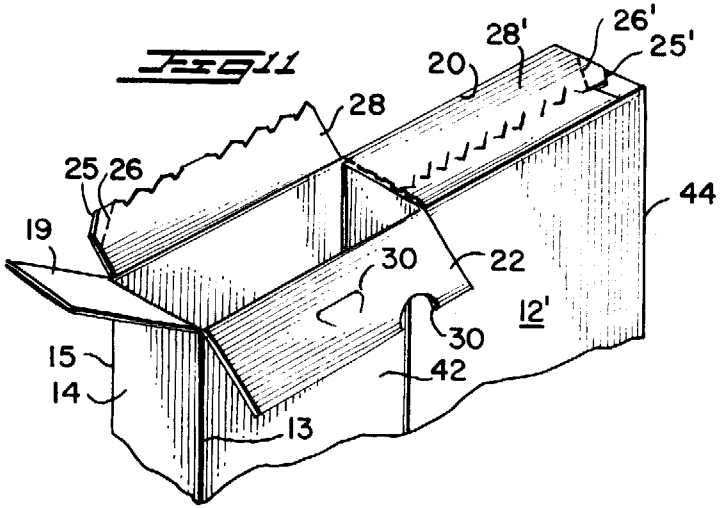
FIG. 11 is a partial perspective view of the carton formed from the blank of FIG. 10 showing one compartment open; and, FIG. 12 is a top view of the formed and sealed carton formed from the blank of FIG. 10.

FIGS. 10–12 show a third embodiment of the present wherein the primary carton forming elements utilized are the same or equivalent to those elements used in the carton of FIGS. 1–3 and 4–7. However, for this third embodiment, the specific carton shown is divided into two parts and the carton opening means for the top of the carton is arranged so that each part can be opened individually of the other. That is, the blank of FIG. 10 includes in addition to the primary carton walls an integral divider panel 42 separated from the side wall 12 by a fold line 43. In addition, the carton closure flap and the other side wall are each divided into two portions by an imaginary line 40 between side wall panels 16,16' and a coterminous perforated line 41 between top closure flap 28,28'. Further, even though the carton opening perforated line 27,27' is continuous across the top of the carton, each end of the top closure flap element 28,28' is provided with a separate fold line 26,26' and a seperate carton opening tab 25,25'. Finally, like the carton shown in FIGS. 4–7, the top of the carton of FIGS. 10–12 uses full sized top closure flaps 28,28' and 22,22' with the attendant carton opening reclosure means i.e., tabs 31,31' and slots 30,30' as shown in FIGS. 8–9.

The arrangement of the various panels on the blank shown in FIG. 10 is only one that could be successfully used. In this respect, the blank shown would form an economy type carton using a minimum amount of paperboard. Thus, in order to form a carton from the blank of FIG. 10, adhesive is applied to the glue flap 10 from a top glue pot. The left side of the blank is then folded about fold line 13 to adhere glue flap 10 to side wall 16' slightly to the right of the imaginary line 40. Next, adhesive is applied to the right side of the blank along the edge of side wall 12' and over the area 47' separated from top closure flap 22' by the perforated line 46'. Subsequently the blank is then folded a second time from right to left about fold line 17 to adhere side wall panel 12' to side wall panel 12. The portion 47' of top closure flap 22' is similarly adhered to top closure flap 22 to complete the gluing sequence for the carton.

When the carton blank, glued as set forth above is then squared, filled and closed, the result yields a carton substantially as shown in FIGS. 11 and 12. In FIG. 12, the top of the carton is illustrated showing the closure flap 28,28' divided front-to-back by the continuous perforated line 27,27' and divided from side-to-side by the perforated line 41. In addition, the separate carton opening tabs 25,25' and their fold lines 26,26' are also shown in FIG. 12. In FIG. 11, one half of the carton is shown open while the other half remains closed. In this latter view, the carton bridge 42 can be seen which divides the carton conveniently into two separate compartments from side-to-side, each having a separate opening means.

Thus in each embodiment of the invention, there is provided a ripped, easy opening means for a carton comprising a single substantially straight perforated line and at least one integral carton opening tab, particularly adapted for use on thin profile cartons. The invention has been specifically disclosed for use on cartons having a top opening with a minor depth dimension from front-to-back, but it should be understood that the identical easy opening means could just as readily be used on the ends of a thin profile carton having a minor depth dimension from top-to-bottom. In addition, although the integral carton opening tab 25 has only been shown at one end of the portion 28 of closure flap 24 in FIGS. 1–3 and 4–7, it should be understood that a similar carton opening tab could also be provided at the opposite end of the portion 28 where the carton size and configuration so dictated specifically as shown in FIGS. 10–12.

Accordingly, what has been disclosed and is desired to be protected by United States Letters Patent should not be limited by the details set forth hereinbefore, but should be interpreted within the scope of the invention as defined in the appended claims.

I claim:

1. A rectangular paperboard carton of thin profile, having a depth dimension from front-to-back substantially less than its width dimension from side-to-side, and consisting of a plurality of side walls with closure flaps attached to the free ends thereof, said closure flaps including a pair of opposed secondary flaps foldably attached to the side walls along the depth dimension of said carton and a pair of opposed primary flaps including a lowermost primary flap and an uppermost primary flap foldably attached to the side walls along the width dimension of said carton, said opposed primary flaps each having a length dimension less than the depth dimension of said carton so as to only partially overlap one another at their extreme free edges when folded and secured together, the improvement residing in an easy opening means applied to the uppermost one of said primary closure flaps, said easy opening means comprising:

a. a single, substantially straight perforated tear line in the uppermost primary closure flap located near the extreme free edge thereof so as to lie along the width dimension of said carton at or near the geometric center of the depth dimension of said carton in its erected condition;

b. said perforated tear line commencing at one edge of said uppermost primary closure flap and continuing in said closure flap along the width dimension of said carton to the opposite edge of said uppermost primary flap; and, c. at least one unsecured carton opening tab integral with and wholly formed within said uppermost primary closure flap at one side thereof, said carton opening tab being defined by a fold line in said uppermost primary closure flap that extends from one edge of said primary closure flap to intersect said perforated tear line whereby the carton is opened by inserting a opening means underneath the unsecured carton opening tab so as to tear the uppermost primary closure flap along the single perforated tear line.

2. The carton of claim 1 wherein a second unsecured carton opening tab is integrally formed within said uppermost primary closure flap at the opposite side thereof by a second fold line which intersects said perforated tear line.

3. The carton of claim 1 wherein the opposed primary closure flaps each have a length dimension that is substantially equal to the depth dimension of said carton so as to completely overlap one another when folded and secured together in a common area near the extreme free edge of said uppermost primary flap and said perforated tear line is located substantially centrally of said uppermost primary flap.

4. The carton of claim 3 wherein a second unsecured carton opening tab is integrally formed within said uppermost primary closure flap at the opposite side thereof by a second fold line which intersects said perforated tear line.

5. The carton of claim 4 wherein at least one carton locking slit is provided in said lowermost primary closure flap located so as to coincide with the unsecured free edge of said perforated tear line in the closed condition of said carton.

6. The carton of claim 4 wherein at least the uppermost primary closure flap is divided from side-to-side along its width dimension by a perforated line and said carton itself is divided from side-to-side along its width dimension by a carton dividing bridge panel.

7. The carton of claim 6 wherein at least two carton locking slits are provided in said lowermost primary closure flap located so as to coincide with the unsecured free edge of said perforated tear line on each side of said carton divider in the closed condition of said carton.

* * * * *